US006023864A

United States Patent [19]

Liebenow

[11] Patent Number: 6,023,864

[45] Date of Patent: Feb. 15, 2000

[54] DISPLAY PANEL FOR DETACHABLY ENGAGING THE TEMPLE OF EYE WEAR

[76] Inventor: Mark Liebenow, 684 Northbrook Way, Webster, N.Y. 14580

[21] Appl. No.: 08/801,016

[22] Filed: Feb. 19, 1997

Related U.S. Application Data

[63] Continuation-in-part of application No. 08/239,209, May 6, 1994, abandoned.

[51] Int. Cl.[7] ..... G09F 3/10

[52] U.S. Cl. ..... 40/299.01; 40/666; 24/482

[58] Field of Search ..... 40/299.01, 305, 40/316, 321, 334, 658, 665, 666; 24/17 B, 482

[56] References Cited

U.S. PATENT DOCUMENTS

| | | | |
|---|---|---|---|
| 340,238 | 4/1886 | Palmer | 24/17 B X |
| 350,149 | 10/1886 | Palmer | 24/17 B X |
| 369,543 | 9/1887 | Matthews | 24/17 B X |
| 678,830 | 7/1901 | Voigt | 40/665 |
| 1,630,888 | 5/1927 | Brown | 24/17 B |
| 2,094,210 | 9/1937 | Graben | 40/665 |
| 2,328,206 | 8/1943 | Fowler . | |
| 2,874,495 | 2/1959 | Fowler . | |
| 3,738,034 | 6/1973 | Seaver | 40/665 |
| 3,992,749 | 11/1976 | Getchell . | |
| 4,184,275 | 1/1980 | Thornell . | |
| 5,387,012 | 2/1995 | Hibbs | 40/665 X |
| 5,477,631 | 12/1995 | Hewitt . | |
| 5,775,018 | 7/1998 | Steinborn | 40/299.01 X |
| 5,778,583 | 7/1998 | Larsen | 40/665 X |

FOREIGN PATENT DOCUMENTS

| | | | |
|---|---|---|---|
| 2065792 | 4/1992 | Canada . | |
| 504307 | 4/1939 | United Kingdom | 40/665 |
| 560623 | 4/1944 | United Kingdom | 40/665 |
| 2240131 | 7/1994 | United Kingdom . | |

*Primary Examiner*—Brian K. Green
*Attorney, Agent, or Firm*—Harter, Secrest & Emery LLP; Brian B. Shaw

[57] ABSTRACT

An accessory for releasably engaging a temple of eye wear to display a user selected indicia is disclosed. The accessory includes a substantially planar display panel having a display surface and a back surface. A riser is connected to the back surface to lie within a periphery of the back surface. The riser includes a contact surface and opposing edges. A first tab projects from the riser and lies within the periphery of the back surface, wherein a first retaining lip extends substantially perpendicular from the first tab. A second tab projects from the riser and lies within the periphery of the back surface, wherein a second retaining lip extends substantially perpendicular from the second tab, such that the contact surface extends between the first tab and the second tab. A resilient engaging arm engages the first tab, the second tab and the edges of the riser, wherein the resilient engaging arm, the edges of the riser, the first tab and the second tab are selected to dispose the contact surface above a bottom of the resilient engaging arm, as the resilient engaging arm engages the edges of the riser.

10 Claims, 5 Drawing Sheets

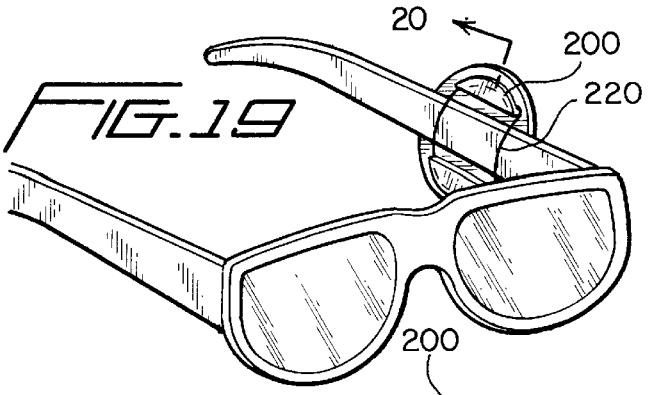
FIG. 19
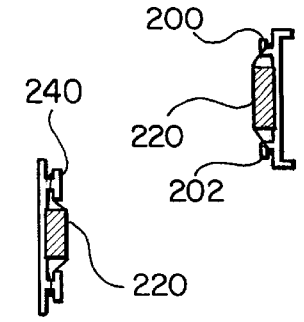
FIG. 20
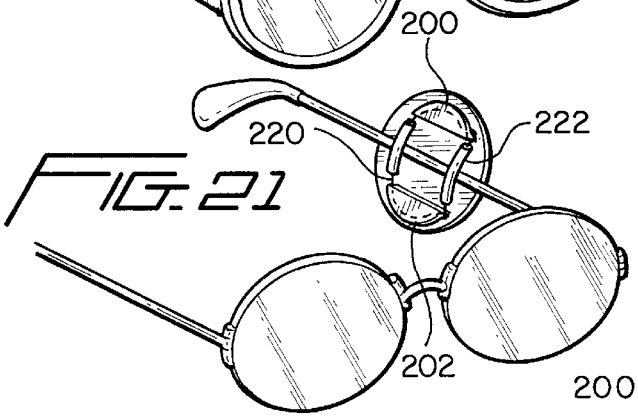
FIG. 21
FIG. 22a
FIG. 21a
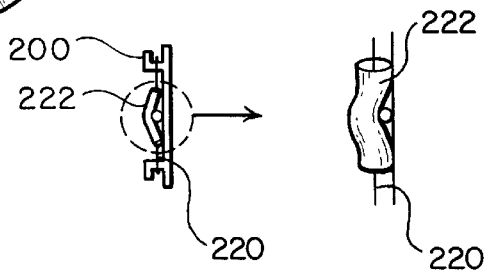
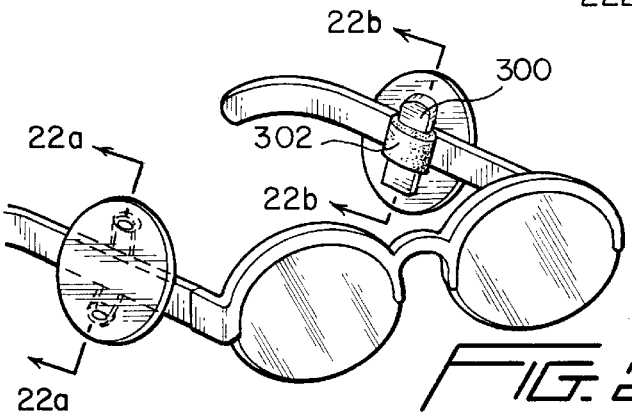
FIG. 22b
FIG. 22
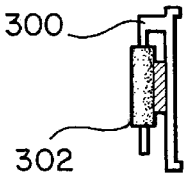
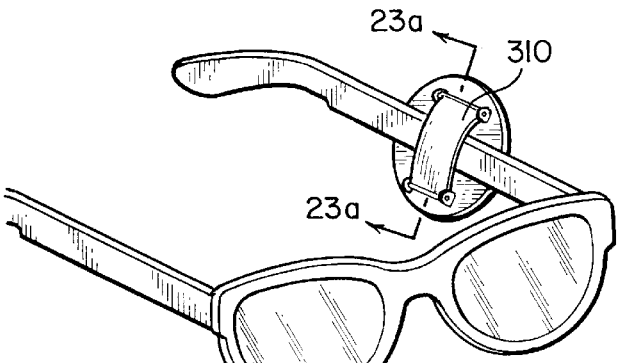
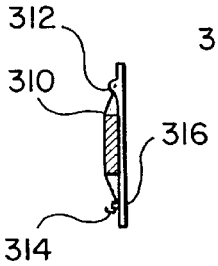
FIG. 23a
FIG. 23

DISPLAY PANEL FOR DETACHABLY ENGAGING THE TEMPLE OF EYE WEAR

This application is a continuation-in-part of U.S. patent application Ser. No. 08/239,209 filed May 6, 1994, now abandoned, in the name of Mark Liebenow.

FIELD OF THE INVENTION

The present invention relates to accessories for eye wear, and more particularly, to a display panel having an attachment mechanism for releasably engaging a temple of eye wear for permitting the display of a user selected indicia.

BACKGROUND OF THE INVENTION

The promotion of an affiliation or support of a given team, company or cause, often includes the display of an identifying indicia or insignia, label or motto. Traditionally, hats, shirts, buttons and stickers have been used to provide the association of a selected indicia with the individual. These devices are separate units which do not generally cooperate with existing items of the user. In fact, it is often difficult to incorporate these desired indicia with existing clothing or apparel. Therefore, it is the object of the present invention to provide a device for displaying a user selected indicia, wherein the device cooperates with eye wear for locating the indicia in a visible yet unobtrusive manner with respect to the eye wear.

SUMMARY OF THE INVENTION

The present invention includes an accessory for releasably engaging the temple of eye wear to display a user selected indicia. The accessory may be used with prescription or non prescription eye wear, and includes a substantially planar display member having a display surface and an engaging surface. A spacing arm projects from the engaging surface to extend a given distance from the engaging surface. An engaging arm operably connected to the spacing arm projects from the spacing arm to overlie a portion of the engaging surface, wherein the spacing arm and the engaging arm are sized to operably retain a portion of the temple intermediate of the engaging surface and the engaging arm and exert a sufficient force upon the temple to operably locate the display member relative to the temple.

In a preferred embodiment, the spacing arm and engaging arm are integral. In addition, the engaging arm may include serrations or grooves for contacting or locating the temple relative to the accessory. Further, the spacing arm may be oriented perpendicular to the engaging surface of the display member.

BRIEF DESCRIPTION OF THE DRAWINGS

FIG. 19 is a perspective view showing an alternate embodiment disposed on the temple of eye wear.

FIG. 20 is a cross section view taken along lines 20/20 of FIG. 19.

FIG. 21 is a perspective view of the alternate embodiment on an alternative style of temple.

FIGS. 21*a* and 21*b* are an enlarged side elevational view of a portion of the embodiment of FIG. 21.

FIG. 22 is a perspective view showing a further configuration of the present invention disposed on the temple of eye wear.

FIG. 22*a* is a section view showing the alternative construction employing the resilient retaining arm and a pair of opposed bosses.

FIG. 22*b* is a cross section view taken along lines 22*b* of FIG. 22.

FIG. 23 is a perspective view showing a further embodiment on the temple of eye wear.

FIG. 23*a* is a cross sectional view taken along lines 23*a* of FIG. 23.

DETAILED DESCRIPTION OF THE PREFERRED EMBODIMENT

Figure 1:
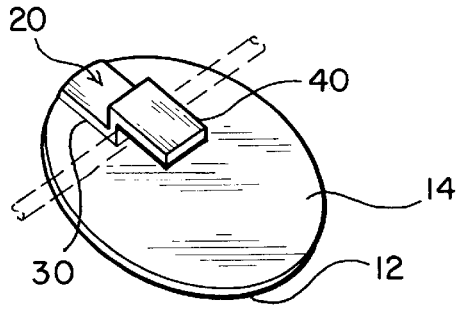
FIG. 1 is a perspective view of a configuration of a first embodiment.
Figure 2:
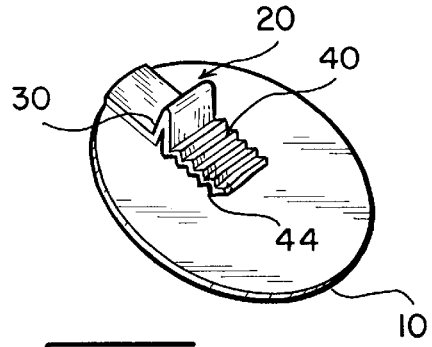
FIG. 2 is a perspective view of an alternate configuration of a first embodiment.
Figure 16:
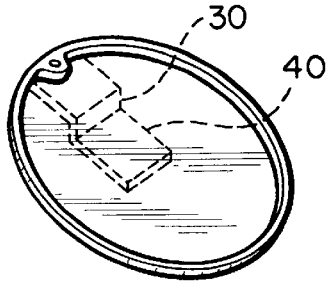
FIG. 16 is a perspective view of an alternate configuration for attaching the user selected indicia to the member.
Figure 17:
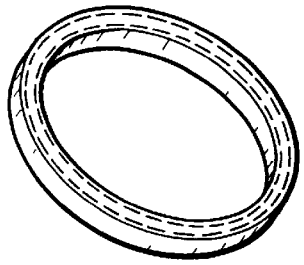
FIG. 17 is a perspective view of an alternate configuration for attaching the user selected indicia to the member.
Figure 3:
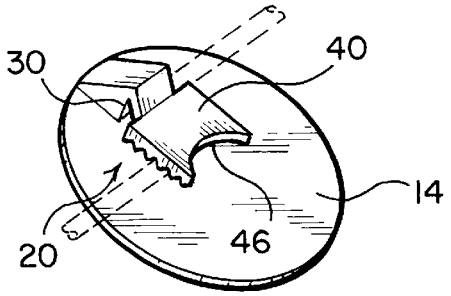
FIG. 3 is a perspective view of an alternate configuration of a first embodiment.
Figure 4:
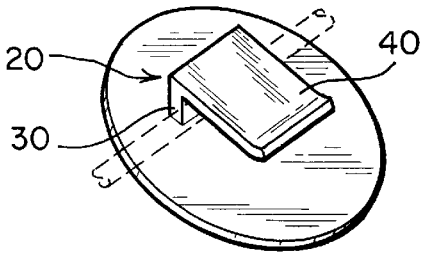
FIG. 4 is a perspective view of an alternate configuration of a first embodiment.
Figure 5:
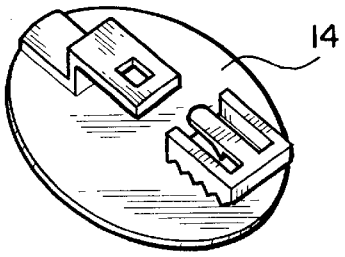
FIG. 5 is a perspective view of a configuration of a second embodiment.
Figure 6:
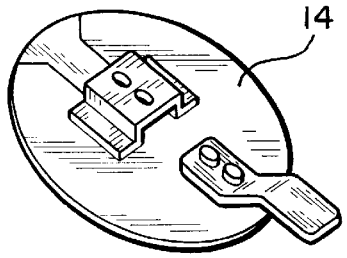
FIG. 6 is a perspective view of an alternate configuration of a second embodiment.
Figure 7:
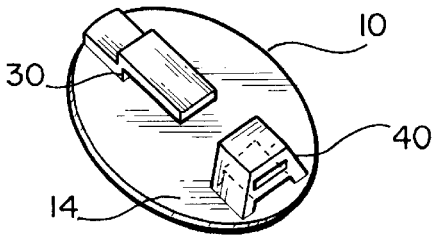
FIG. 7 is a perspective view of an alternate configuration of a second embodiment.

Referring to FIGS. 1–4 and 14, a first embodiment of the present invention is shown. Referring to FIGS. 5–15, a second embodiment of the above invention is shown.

In each embodiment, the present invention includes a substantially planar display member 10, having a first planar receiving surface 12 and a second engaging surface 14. The planar receiving surface 12 is sized to receive a user selected indicia, such as labels, stickers or magnetic elements. Alternatively, the display member 10 may include permanently affixed indicia such as an enameled or painted on indicia.

Referring to FIGS. 1–4 and 14, the first embodiment of the present invention includes a one piece mechanism 20 for cooperatively retaining the accessory to the temple of eye wear such as prescription glasses or sunglasses. A spacing arm 30 projects from the engaging surface 14 of the display member 10. The spacing arm 30 may have a variety of configurations, but preferably extends substantially perpendicular to the plane of the display member 10. An engaging arm 40 extends from the spacing arm 30 so as to overlie a portion of the engaging surface 14. The engaging arm 40 may be substantially parallel to the engaging surface 14, or may diverge or converge from the engaging surface as the arm extends from the spacing arm 30. The engaging arm 40 may include a plurality of recesses or grooves 44 sized to cooperatively engage the temple of the eye wear so as to retain the accessory in a predetermined orientation, including vertical positioning relative to the temple. The size and spacing of grooves 44 may define similar cross sections, or be configured so as to accommodate a variety of temple cross sections. Further, the engaging arm 40 of the first embodiment may include a thumb recess or a curved end 46 for assisting engagement with the temple.

Figure 18:
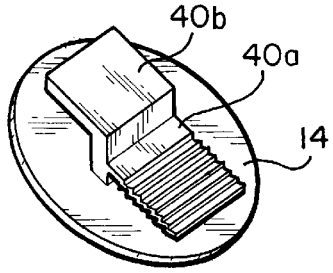
FIG. 18 is a perspective view of an alternate embodiment.

As shown in FIG. 18, the present invention may include a first engaging arm 40*a* projecting from one side of the spacing arm 30 and a second engaging arm 40*b* projecting from an opposite side of the spacing arm such that the first and second arms 40*a* and 40*b* are spaced at unequal distances from the engaging surface 14. One or both of the engaging arms 40*a*, 40*b* may include the grooves 44 for seating a portion of the temple.

Figure 12:
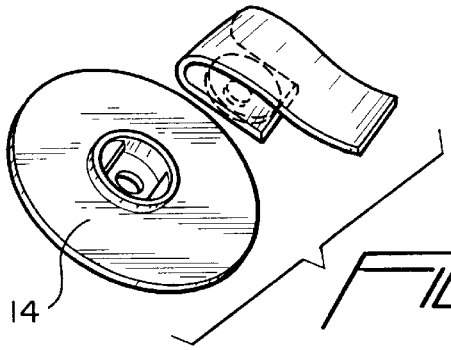
FIG. 12 is a perspective view of an alternate configuration of a second embodiment.
Figure 13:
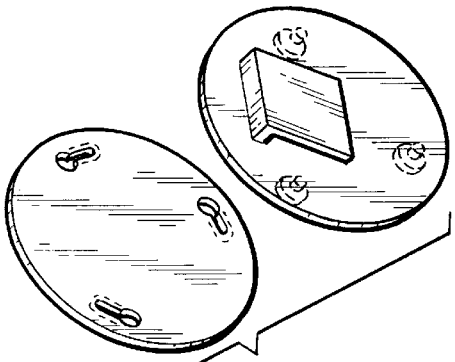
FIG. 13 is a perspective view of an alternate configuration of a second embodiment.
Figure 14:
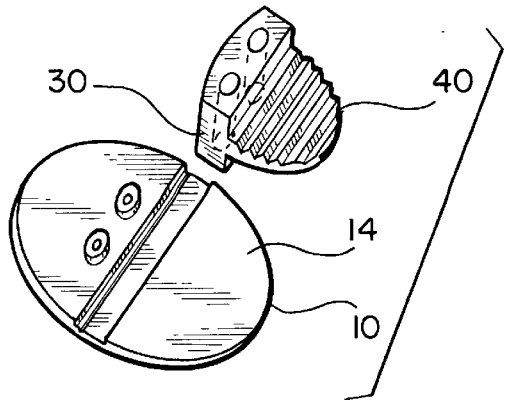
FIG. 14 is a perspective view of an alternate configuration of a second embodiment.
Figure 15:
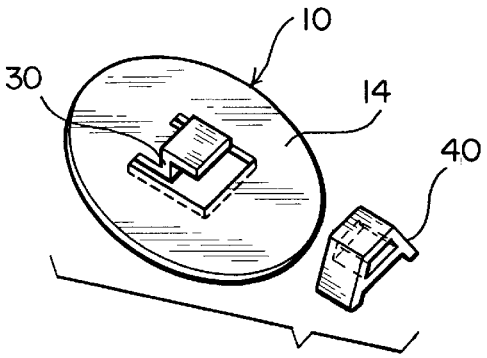
FIG. 15 is a perspective view of an alternate configuration of a second embodiment.

Alternatively, as shown in FIGS. 12 and 13, the display surface 12 may include a means such as cooperating pins and recesses, or hook and loop fasteners for engaging a detachable indicia bearing member to the engaging surface 14, spacing and engaging arms 30, 40.

In the first embodiment, the spacing arm 30 and the engaging arm 40 are integrally formed with each other as well as the display member 10. As shown in FIGS. 5–15, the spacing arm 30 and engaging arm 40 may be formed of separate components such that the engaging arm releasably engages the spacing arm to retain the temple between the engaging arm and engaging surface 14. As in the first embodiment, the engaging arm 40 of the second embodiment may include grooves or indentations 44 for accommodating thin temples or a variety of temples. The engaging arm 40 may be releasably connected to the spacing arm 30 by a variety of mechanisms such as corresponding detents and projections, bias tongues with catches, friction fit or engaging biased tabs which connect the engaging arm 40 to the spacing arm 30 and may assist in engaging or disengaging the temple.

Figure 8:
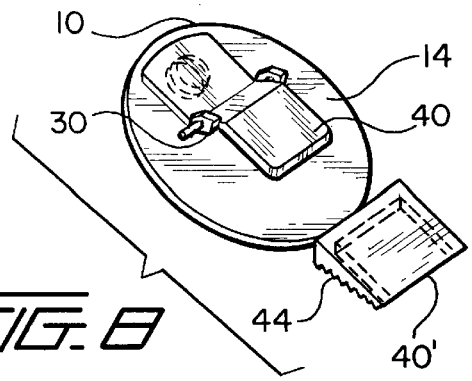
FIG. 8 is a perspective view of an alternate configuration of a second embodiment.
Figure 9:
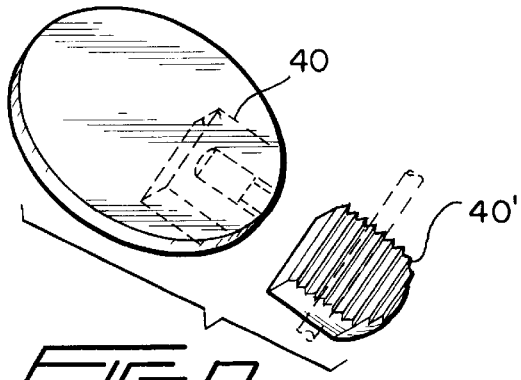
FIG. 9 is a perspective view of an alternate configuration of a second embodiment.

Referring to FIGS. 8 and 9, the engaging arm 40 may be spaced from the engaging surface 14 by a sufficient distance to accommodate relatively thick temples. An engaging arm 40' may be connected to the engaging arm 40 to reduce the distance between the engaging surface 14 and the engaging arm, thereby accommodating different sized temples, and especially relatively thin temples.

In these embodiments, the temple of the eye wear is cooperatively engaged between the engaging surface 14 of the display member 10 and the engaging arm 40 so as to retain the display member in a predetermined orientation with respect to the temple. In addition, upon locating the temple intermediate of the engaging surface 14 and the engaging arm 40, the temple may be positioned adjacent to, or contacting the spacing arm 30 to vertically locate the display member 10 relative to the temple.

Figure 10:
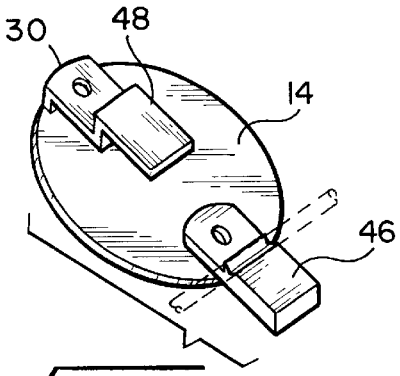
FIG. 10 is a perspective view of an alternate configuration of a second embodiment.
Figure 11:
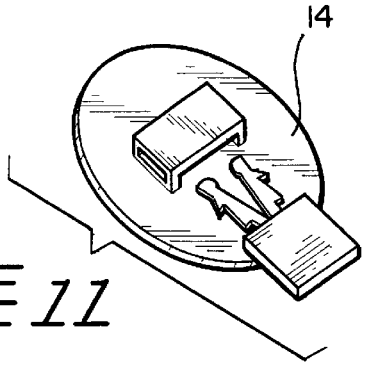
FIG. 11 is a perspective view of an alternate configuration of a second embodiment.

Referring to FIG. 10, the engaging arm 40 is constructed to include a bottom half 46 and a top half 48, wherein the top half is integrally formed with the spacing arm 30 and the bottom half releasably engages the spacing arm to retain a portion of the temple intermediate of the top half and the bottom half.

The present invention may be formed of any suitable plastics material, such as thermosetting or thermoplastic, or metal or any desired material. Preferably the material exhibits sufficient resiliency to retain the temple between the engaging arm 40 and the engaging surface 14.

Alternative Embodiments

Referring to FIGS. 20–27, alternative embodiments of the present invention are disclosed.

In particular, the engaging surface may include a pair of opposing tabs 200, 202 projecting from the engaging surface. Preferably, each tab 200, 202 forms a substantially L-shaped elevational cross section. The tab includes an upwardly projecting leg and a retaining lip extending from the leg. The retaining lip of a tab extends away from the remaining tab. Further, as shown in the figures, the tab defines an arcuate or radiused curvature in a top plan view. That is, the tab 200, 202 preferably defines a curvilinear path between the retaining lip and the engaging surface.

An engaging arm 220 in the form of an elastomeric member is stretched between the tabs to capture a portion of the temple between the elastomeric member and the engaging surface. The elastomeric member is disposed between the retaining lip and engaging surface as it passes about a tab 200, 202. The elastomeric member functions as a resilient engaging arm 220 to provide a retaining bias for securing the display panel relative to the temple.

Further, contemplated is a resilient engaging arm 220 in the form of an elastomeric member may include a sock or sleeve 222 for directly contacting the temple. The sock or sleeve 222 may be formed of a resiliently compressive material such as neoprene or padded fabric. Preferably, the sleeve 222 has a sufficient thickness to retain a display panel relative to a relatively thin temples. That is, the sleeve 222 compresses to substantially receive a diameter of the temple.

Alternatively, as shown in FIGS. 22, 22*b*, 27*a* and 27*b*, it is contemplated a resilient clip 300 may extend from the back side of the display member. A spacer 302 may be disposed upon a portion of the clip 300 to retain the temple between the spacer and the engaging surface.

In a further embodiment as shown in FIGS. 23 and 23*a*, a preloaded resilient engaging arm 310 having a pivot end 312 and a catch end 314 may be hingedly or fixedly attached to the engaging surface at the pivot end of the arm. The catch end 314 of the arm extends from the pivot end 312 a sufficient distance to dispose a portion of the temple therebetween the ends of the arm. The catch end 314 releasably engages a corresponding hook 316 connected to the engaging surface to secure the display member to the temple. The engaging arm 310 thus extends from the hinged or fixed point over the temple to engage the hook/catch.

Figure 24:
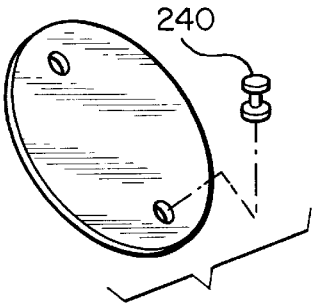
FIG. 24 is an exploded perspective view showing the engaging surface of the alternative embodiment having a boss.
Figure 25:
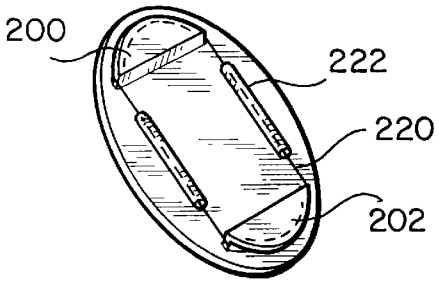
FIG. 25 is a perspective view showing the engaging surface of the alternative embodiment with the retaining tabs and the resilient engaging arm disposed therebetween, wherein the engaging arm includes a gripping sleeve.

Further, referring to FIG. 24, it is contemplated the tabs may be in the form of a boss 240 which is frictionally retained or bonded to the engaging surface. A pair of bosses or a configuration of bosses may be used to dictate the configuration of the elastomeric engaging arm. The location of these bosses 240 may be used to enhance the retention offered by the engaging arm 220 or alternatively locate the sleeves at a desired location with respect to the display member and the particular temple. That is, the bosses define the path of the elastomeric member and depending upon the length of the path defined by the bosses set the tension in the elastomeric member and hence the retaining force.

Further, it is contemplated that depending upon the thickness of the temple to be employed, the thickness of the spacer or sock may be varied in either the opposed tab 200, 202 configuration or the resilient clip 300 embodiment. The present design thus provides a wide range of adaptability to accommodate temples of various cross sectional areas and configurations.

Figure 28:
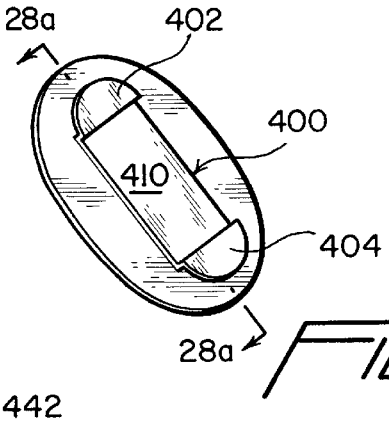
FIG. 28 is a perspective view of a further embodiment employing the tabs.
Figure 28A:
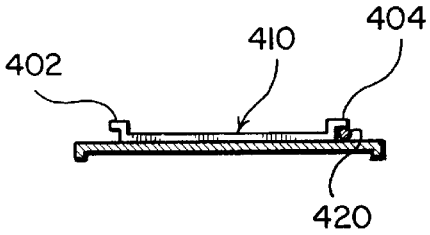
FIG. 28*a* is a cross sectional view taken along lines 28*a*—28*a* of FIG. 28.

In an alternative configuration shown in FIG. 28, the present invention may employ a riser 400, wherein the spaced apart tabs 402, 404 extend upwardly from the riser. The riser 400 defines a central contact area 410. The contact area 410 of the riser 400 is spaced from the adjacent surface of the engaging surface by the thickness of the riser. Therefore, as the resilient engaging arm 420 extends around the tabs and along the edge of the riser 400, the resilient engaging arm must be stressed or elongated to dispose a temple between the contact surface of the riser and the raised engaging arm. That is, the first and second tabs 402, 404 are connected to a riser 400. The contact surface 410 is disposed intermediate of the first and second tabs 402, 404 so that the plane of the contact surface is above the bottom of the resilient engaging arm 420. That is, the temple contacts the contact surface 410 of the riser 400 and is retained between the riser and the engaging arm as the engaging arm extends about the tabs. The contact surface 410 may included a textured or serrated surface.

Figure 31:
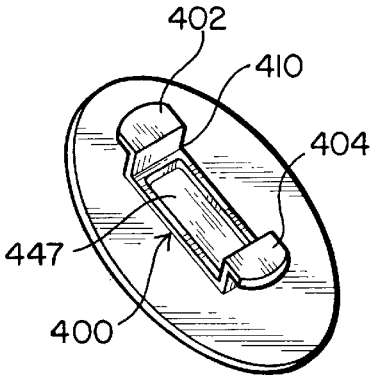
FIG. 31 is a perspective view of a riser including a recess.
Figure 31A:
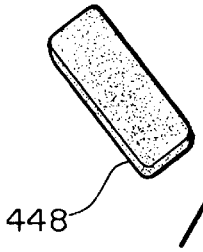
FIG. 31*a* illustrates a textured grip pad.
Figure 31B:
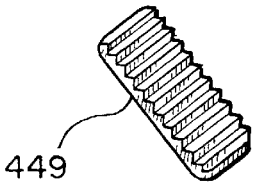
FIG. 31*b* illustrates a serrated grip pad.
Figure 26:
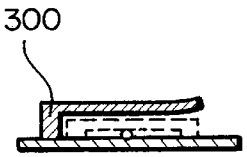
FIG. 26 is a cross sectional elevational view showing an alternative embodiment of the device of FIG. 22*b*.
Figure 27:
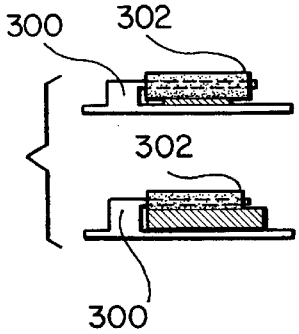
FIG. 27 is a side elevational view showing the alternative embodiment engaging temples of differing thickness.

In an alternative embodiment (as shown in FIG. 31), the riser 400 may include a recess 447 in which a grip pad 448 may be inserted. The grip pad 448 may be frinctionally retained or preferably, adhesively retained, within the recess 447. As shown in FIGS. 31*a* and 31*b*, the grip pad 448 may include a textured surface 448 (FIG. 31*a*) or a serrated surface 449 (FIG. 31*b*). However, other types of surfaces may be employed, depending upon an individual's preferences. The grip pad 448 is preferably a slightly larger thickness than the recess 447 such that the surface of the grip pad 448 exceeds the depth of the recess 447.

Figure 29:
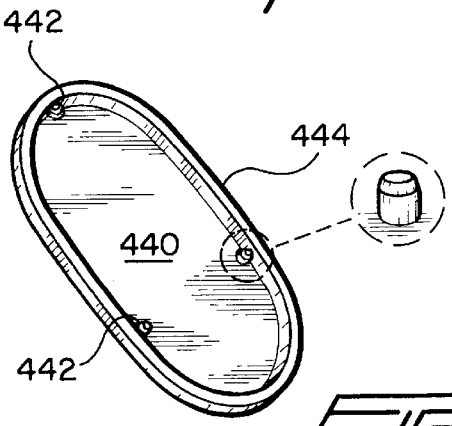
FIG. 29 is a perspective view showing a peripheral flange and locating projections for orienting the indicia with respect to the retaining device.
Figure 30A:
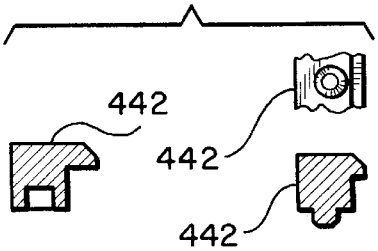
FIG. 30*a* discloses alternative configurations of engaging the collar and the display member.
Figure 30:
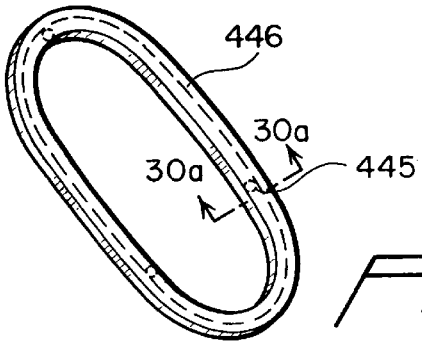
FIG. 30 is a perspective view showing a collar cooperatively engaged with the locating projections and the peripheral flange.

Referring to FIGS. 29 and 30, the display surface 440 is formed with or cooperates with a separate component to form a peripheral flange 442. Adjacent to, or as a part of the flange 442, a locating pin 444 is disposed to orient the indicia relative to the display member. It is understood a plurality of locating pins 444 may be employed. A collar 446 is selected to have a periphery corresponding to the periphery of the flange 442. The collar 446 includes recesses 445 for frictionally engaging the pins 444 to dispose a portion of the indicia intermediate the display surface and the collar.

It is understood that the present invention may be employed with any combination of the feature disclosed, or their equivalents. While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An accessory for releasably engaging a temple of eye wear to display a user selected indicia, comprising:

(a) a substantially planar member having a display surface and a back surface;

(b) a riser having a planar surface connected to the back surface over an entire area of the riser and lying within a periphery of the back surface, the riser having a contact surface opposite the planar surface, the riser having opposing edges;

(c) a first tab projecting from the riser and lying within the periphery of the back surface and a first retaining lip extending substantially perpendicular from the first tab;

(d) a second tab projecting from the riser and lying within the periphery of the back surface and a second retaining lip extending substantially perpendicular from the second tab, the contact surface extending between the first tab and the second tab; and (e) a resilient engaging arm engaging the first tab, the second tab and the edges of the riser, the resilient engaging arm, the edges of the riser, the first tab and the second tab selected to dispose the contact surface above a bottom of the resilient engaging arm, as the resilient engaging arm engages the edges of the riser.

2. The accessory of claim 1, wherein the contact surface is substantially planar.

3. The accessory of claim 1, wherein the contact surface includes a recess sized to engage a length of the temple.

4. The accessory of claim 1, further comprising a plurality of locating pins.

5. The accessory of claim 1, wherein the tabs are sized to substantially preclude rotation of the planar member relative to the temple of the eye wear upon operable engagement with the temple of the eye wear.

6. The accessory of claim 1, further comprising a gripping sock connected to the resilient engaging arm for contacting the temple of the eye wear.

7. The accessory of claim 1, further wherein the riser, the first tab and the second tab are sized to locate a portion of the temple of the eye wear therebetween.

8. The accessory of claim 1, further comprising a magnetic indicia, and the display surface being magnetically attracted to the magnetic indicia.

9. The accessory of claim 1, further comprising a grip pad connected to the back surface intermediate the first and the second tab.

10. The accessory of claim 9, wherein the riser includes a recess sized to receive at least a portion of the grip pad.

* * * * *